US005509194A

United States Patent [19]

Hornung et al.

[11] Patent Number: 5,509,194

[45] Date of Patent: Apr. 23, 1996

[54] POWER CRIMPING TOOL FOR TAPE FEED PRODUCTS

[75] Inventors: Craig W. Hornung, Harrisburg; William H. Bair, Marysville, both of Pa.

[73] Assignee: The Whitaker Corporation, Wilmington, Del.

[21] Appl. No.: 373,711

[22] Filed: Jan. 17, 1995

[51] Int. Cl.[6] ..... H01R 43/045

[52] U.S. Cl. ..... 29/751; 29/753; 29/758; 29/788; 72/452.8

[58] Field of Search ..... 29/252, 750, 751, 29/753, 758, 761, 788; 7/107; 72/410, 424, 452, 453.03, 453.16

[56] References Cited

U.S. PATENT DOCUMENTS

| | | | |
|---|---|---|---|
| 4,489,589 | 12/1984 | Kirsinas et al. | 72/424 |
| 4,627,150 | 12/1986 | Burnett | 29/751 X |
| 4,642,874 | 2/1987 | Litchizer, Jr. | 29/753 X |
| 5,195,354 | 3/1993 | Yasui et al. | 72/452 X |

FOREIGN PATENT DOCUMENTS

| | | | |
|---|---|---|---|
| 52-41877 | 3/1977 | Japan | 29/751 |
| 54-30487 | 3/1979 | Japan | 29/751 |
| 881668 | 11/1961 | United Kingdom | 29/753 |
| 971096 | 9/1964 | United Kingdom | 29/753 |

*Primary Examiner*—Peter Vo

[57] ABSTRACT

A powered hand tool (10) is disclosed for crimping terminals (30) to a conductor. The tool includes a linear actuator (18) for driving a cam (70) along a linear path (272). The cam (70) interacts with a pair of followers (192, 194) to first cause the crimping mechanism (16) to crimp the terminal and then, during the last part of the power stroke, to open the crimping mechanism (16) so that the crimped terminal (30) can be removed during the return stroke. Additionally, during the last part of the power stroke the feed mechanism (22) is actuated to store energy so that during the return stroke the main mechanism can utilize the stored energy to effect the feeding of the next terminal into position for crimping.

13 Claims, 7 Drawing Sheets

156
138
156
54
50
52
186
136
188
194
190
192
190
188
142
140
134
174
176
170
166
178
180
182
24
26
184
164
172
130
208
132
144
216
210
204
214
206
244
246
250
252
242
234
236
248
238
256
240
258
230
228
210
12
254
226
212
106
110
108
80
70
150
154
266
264
268
160
152
224
152
262
260
162
146
158
212
38
202
37
200
20
36
18
14
60
42
40

POWER CRIMPING TOOL FOR TAPE FEED PRODUCTS

The present invention is related to powered hand tools for crimping terminals arranged on a tape onto electrical conductors, and more particularly to improved crimping and tape feed mechanisms therefore.

BACKGROUND OF THE INVENTION

Powered hand tools for crimping terminals onto conductors are often bulky and relatively heavy, making them inconvenient and sometimes difficult to use. Because crimping tools must generate substantial forces to crimp a terminal, the tool must be correspondingly strong, which usually translates into substantial weight. Commonly, such tools utilize a wedge that is driven by an air cylinder between two rollers that are journaled on the ends of a pair of links. The other ends of the links have crimping tooling or dies mounted thereto. As the wedge moves between the rollers the two links pivot like a pair of pliers, causing the tooling to close and crimp a terminal. With such mechanisms, the shut height of the crimping tooling is controlled by bottoming of the dies. It is difficult to repeatably stop the wedge at precisely the same position every cycle since variations in the air pressure that is supplied to the air cylinder will cause the wedge to under travel or to over travel. Any such under travel prevents complete die closure while over travel causes additional stress to the rollers, links, and other structures of the tool. Additionally, such tools typically do not have a tape feed mechanism for automatically feeding terminals arranged on a strip of tape.

What is needed is a powered hand tool that is relatively small and light in weight that has the capability to automatically feed terminals arranged on a strip of tape, and that can generate the required forces to effect a high quality crimp. Additionally, the crimping mechanism should produce a repeatable shut height without over stressing the tool.

SUMMARY OF THE INVENTION

A powered hand tool is disclosed for crimping a terminal onto an electrical conductor. The tool includes a frame and a linear actuator having a piston rod arranged to move in a first direction and a second opposite direction along the longitudinal axis. A terminal crimping mechanism is provided having a fixed crimping jaw is attached to the frame and a cam attached to and carried by the piston rod, the cam having a cam track including first, second, and third portions. An indent member is pivotally attached to the frame and has a cam follower at one end thereof that is adapted for following engagement with the cam track. A movable crimping jaw attached to another end of the indent member and is arranged so that when the indent member is pivoted in one direction the movable crimping jaw matingly engages the fixed crimping jaw. The cam track is arranged so that as the piston rod is moved in the first direction, the follower engages the cam and follows along the first portion of the cam track causing the indent member to pivot in the one direction thereby causing the mating engagement of the movable and fixed jaws. And then, while the piston rod continues to move in the first direction, the follower follows along the second portion of the cam track causing the indent member to pivot in an opposite direction thereby moving the jaws apart.

DESCRIPTION OF THE PREFERRED EMBODIMENT

Figure 1:
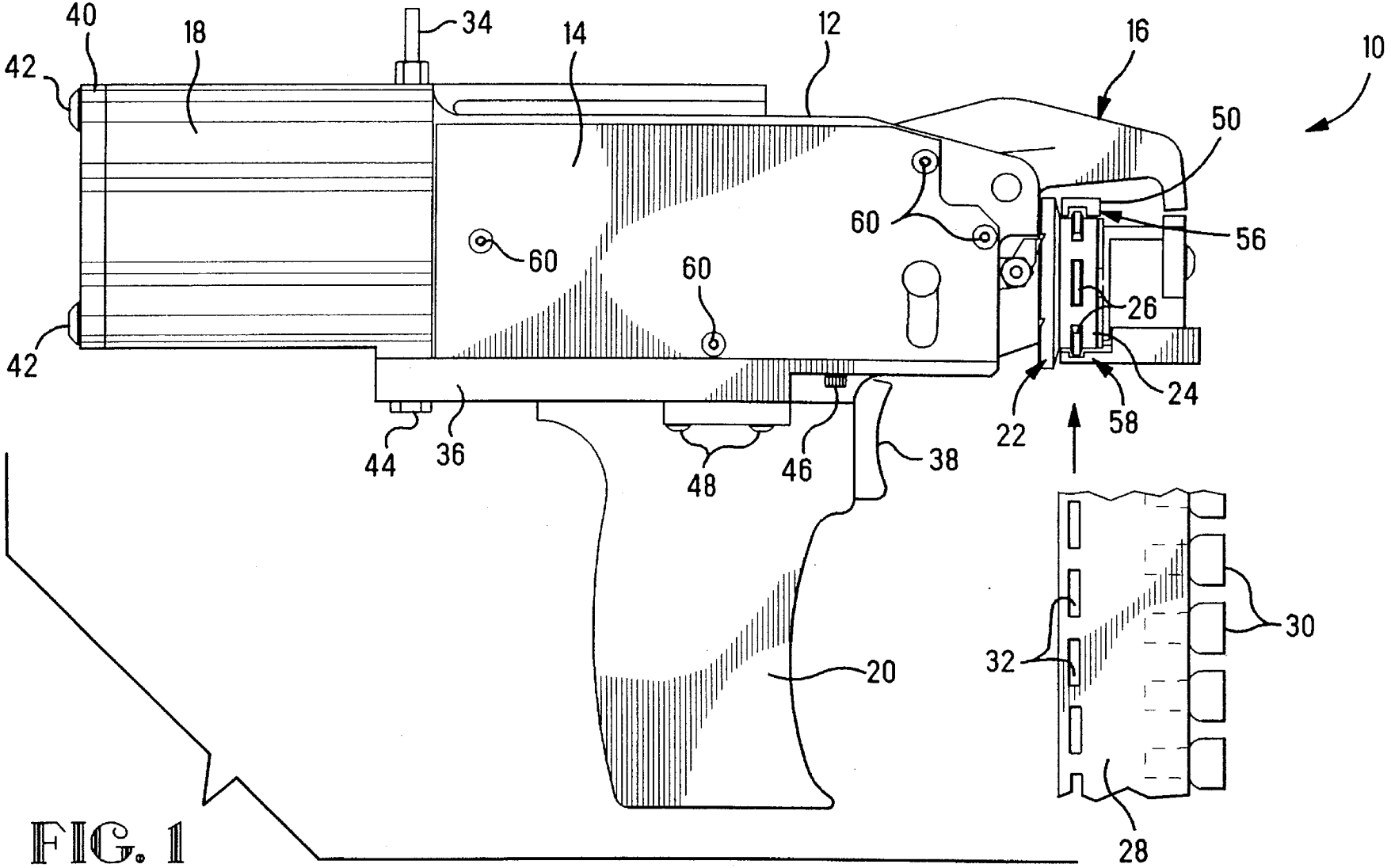
FIG. 1 is a side view of a powered hand tool incorporating the teachings of the present invention.
Figure 2:
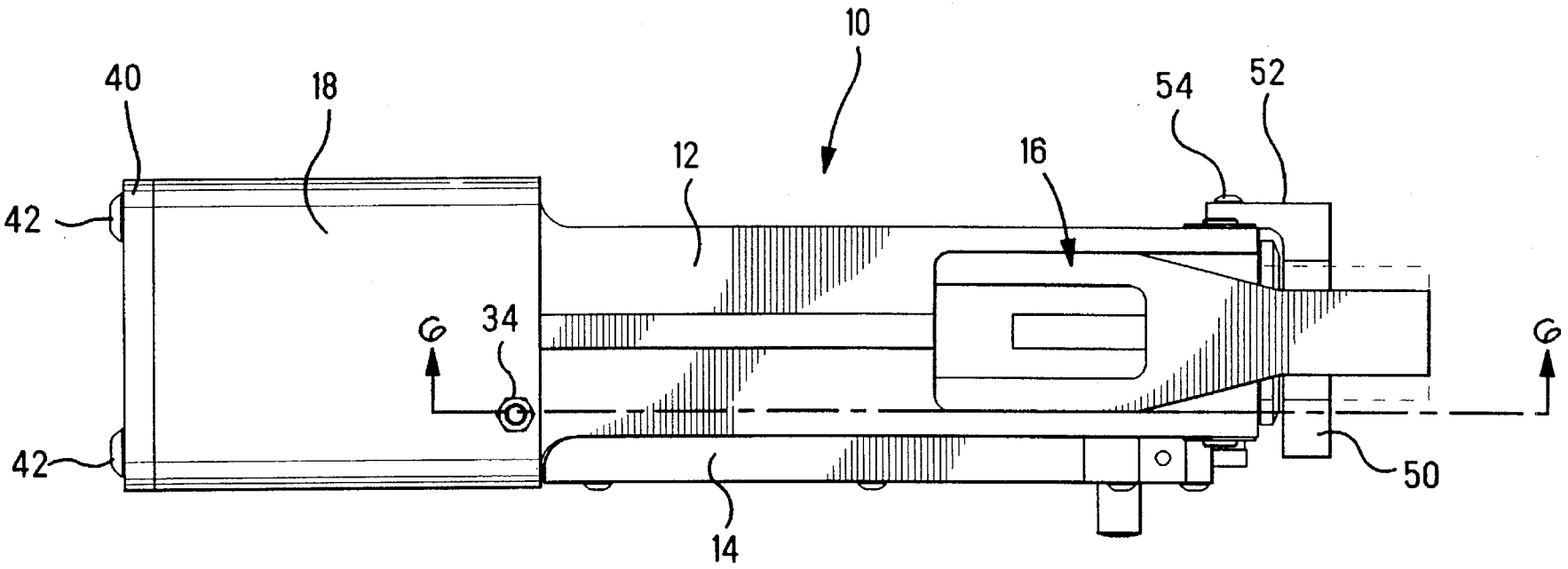
FIG. 2 is a top view of the tool shown in FIG. 1.
Figure 3:
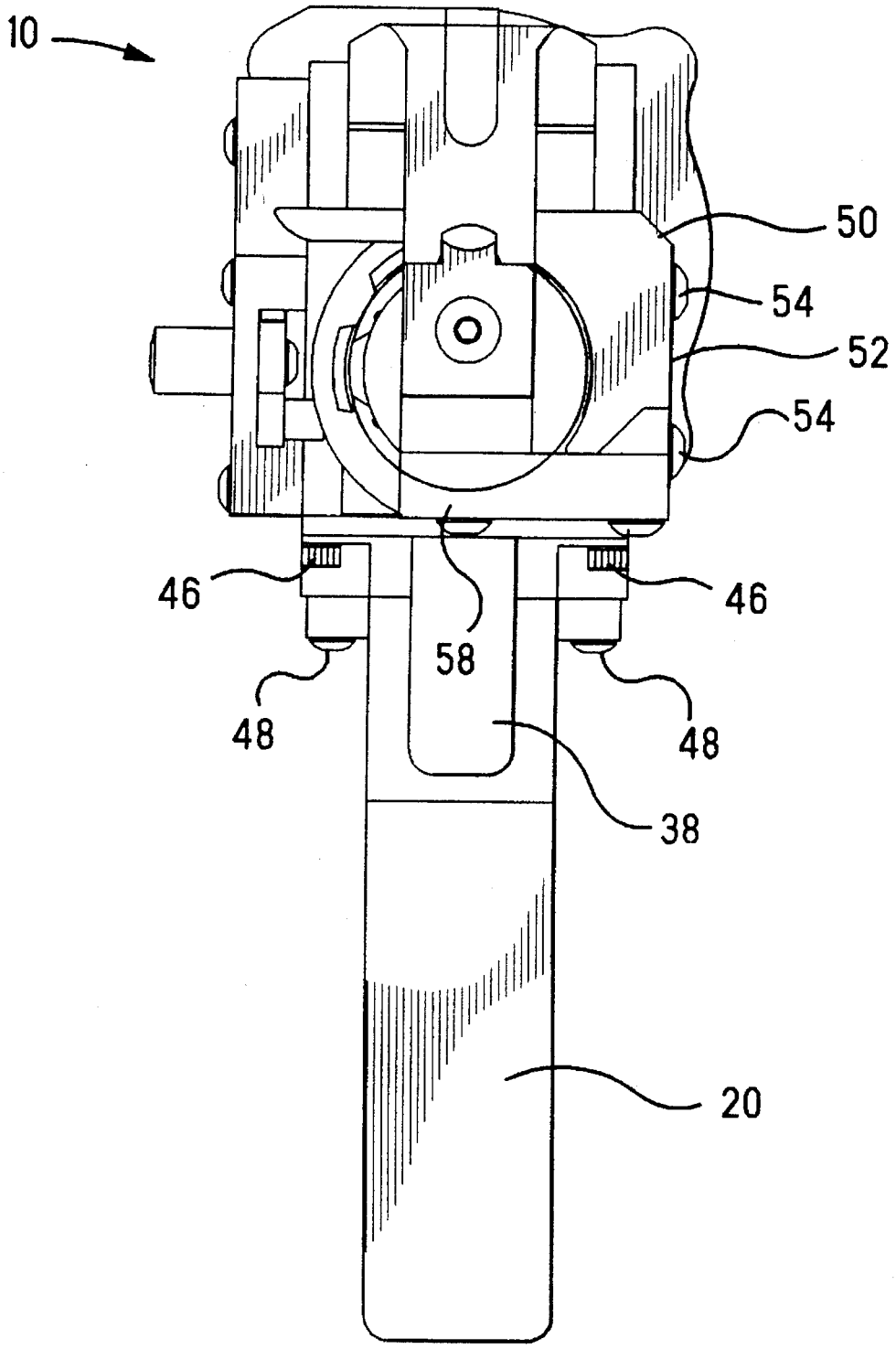
FIG. 3 is a front view of the tool shown in FIG. 1.
Figure 4:
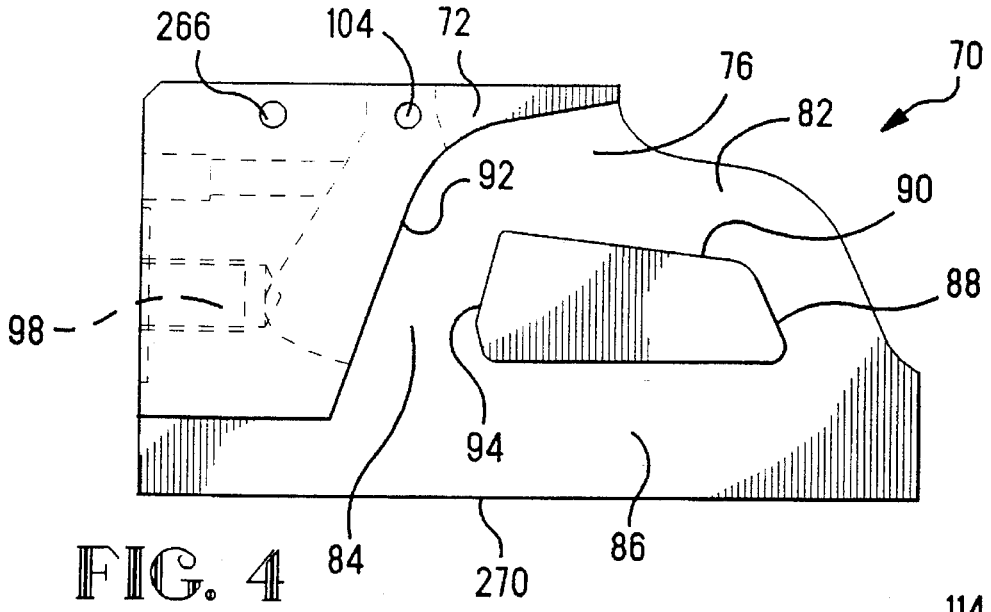
FIGS. 4, 5, 6, and 7 are right side, front, left side, and back views, respectively, of the cam.
Figure 5:
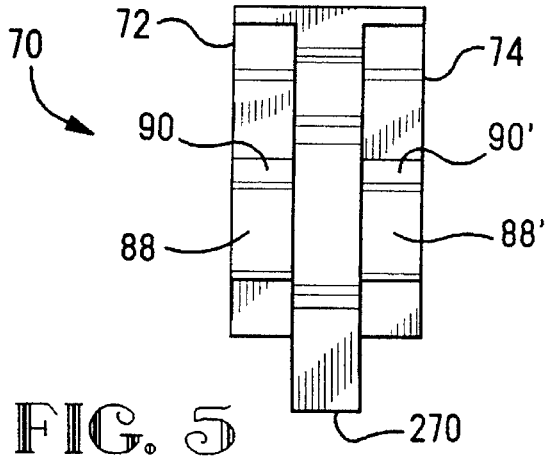

There is shown in FIGS. 1, 2, and 3 a powered hand tool 10 for crimping terminals onto a conductor. The tool 10 includes a frame 12, a plastic side cover 14, a crimping mechanism 16, an air cylinder 18 for actuating the feed mechanism, and a plastic handle 20 for holding and operating the tool. The tool 10 has a feed mechanism 22 including a rotating feed drum 24 having teeth 26 spaced about the periphery of the drum that engage and feed a tape 28 with terminals 30 attached thereto. The tape 28 includes spaced openings 32 along one edge thereof that are engaged by the teeth 26 for feeding and accurately positioning each terminal 30 in turn for crimping. A fitting 34 is provided at the top of the air cylinder for receiving an outside source of compressed air which is routed through the walls of the cylinder into an aluminum manifold 36 and to a control valve 37, shown in FIG. 8, that is operated by a trigger 38, in the usual manner. The air cylinder 18 is made integral to the frame 12, and includes an end cap 40 that is secured in place by means of four bolts 42 which are threaded into holes in the walls of the cylinder. The integral cylinder and frame and the end cap are made of aluminum to limit the overall weight of the tool. While, in the present example, the air cylinder is integral to the frame, it may be a separate part which is bolted to the frame. The manifold is attached to the frame and cylinder by means of three screws 44 and two screws 46, while the handle is attached to the manifold 36 by means of four screws 48. A tape guide 50 is arranged in guiding relationship around one half of the feed drum, as best seen in FIG. 3. The tape guide holds the tape 28 in engagement with the teeth 36 of the drum during operation of the tool 10. The tape guide 50 includes a mounting flange 52 extending therefrom that is attached to a portion of the feed mechanism by means of two screws 54. The feed drum 24 turns clockwise, as viewed in FIG. 3, therefore, the tape 28 enters the feed mechanism at 56 and exits at 58, as best seen in FIG. 1. The cover 14 is attached to the side of the frame 12 by means of four screws 60, and houses the drive linkage for the feed mechanism 22, as will be explained below.

Figure 7:
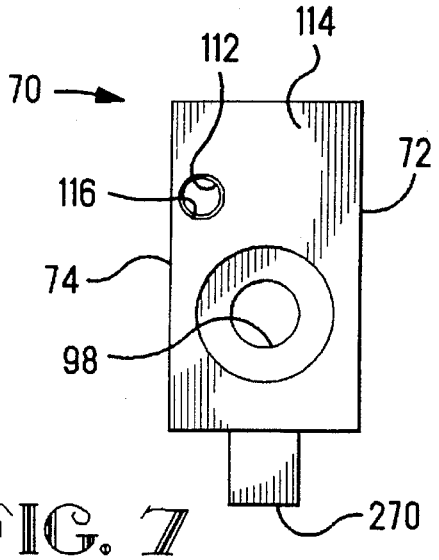
Figure 6:
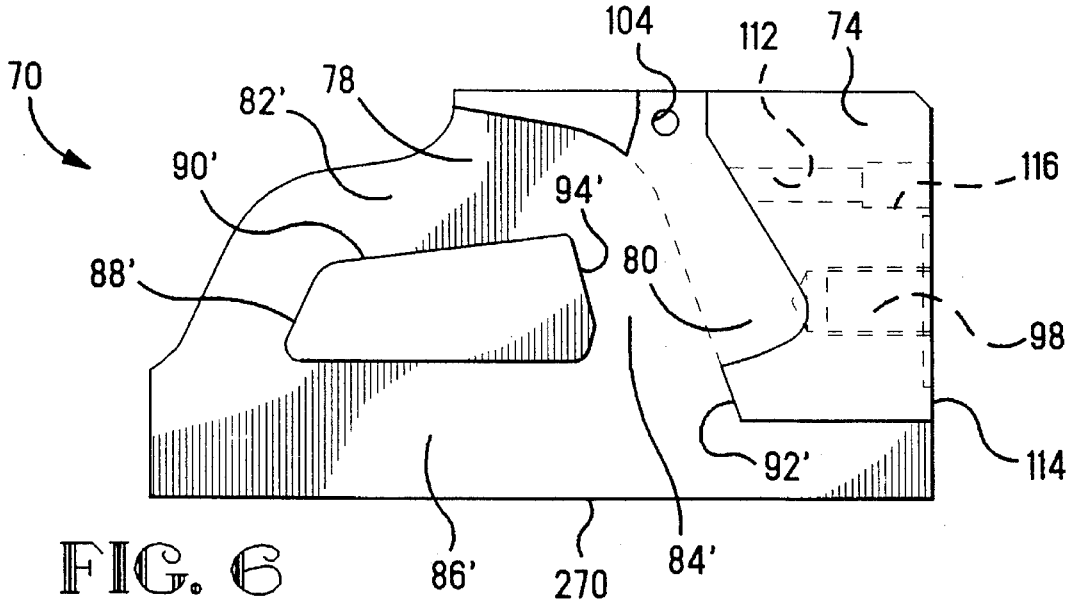
Figure 8:
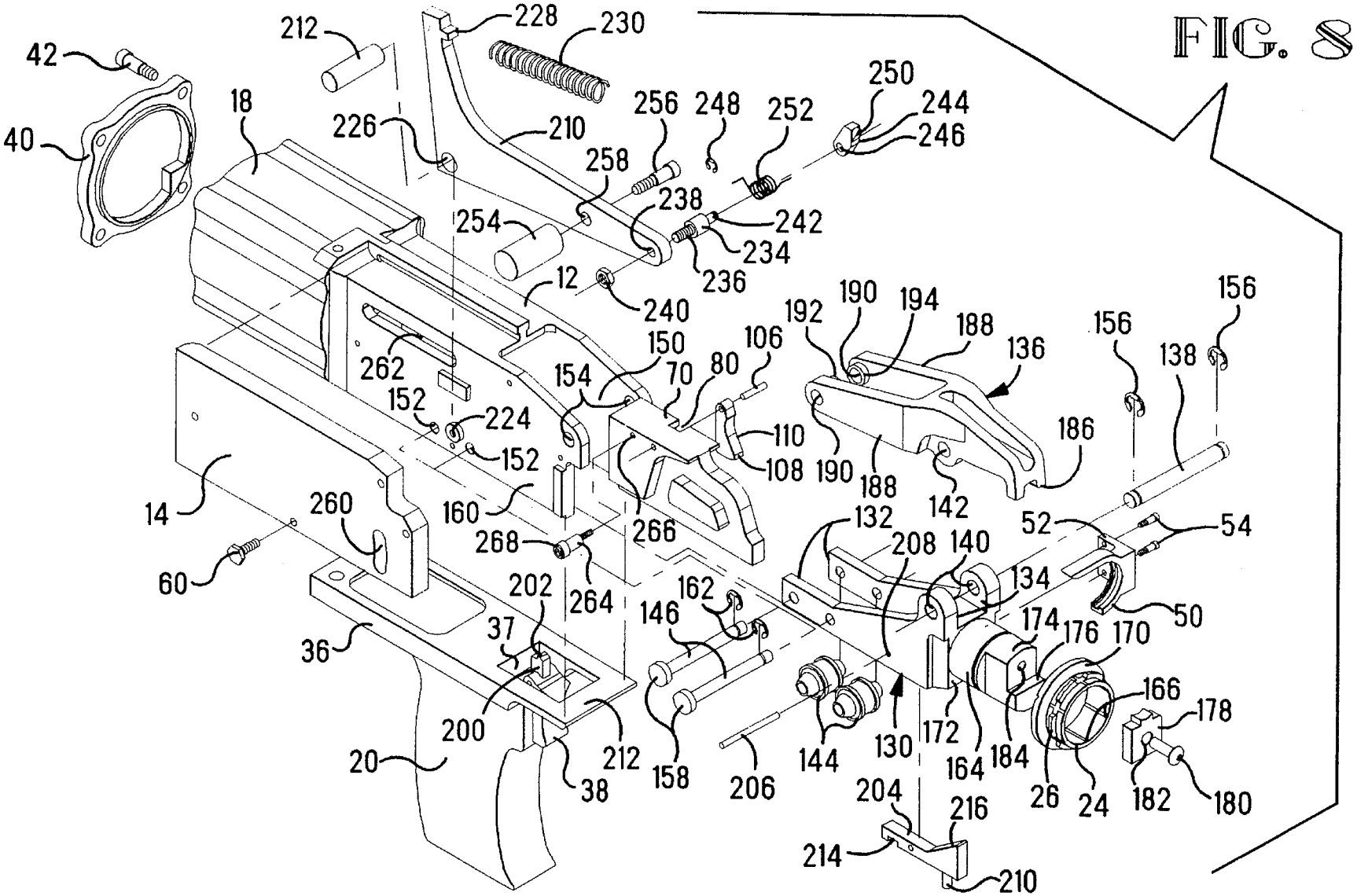
FIG. 8 is an exploded parts view of the tool shown in FIG. 1.
Figure 10:
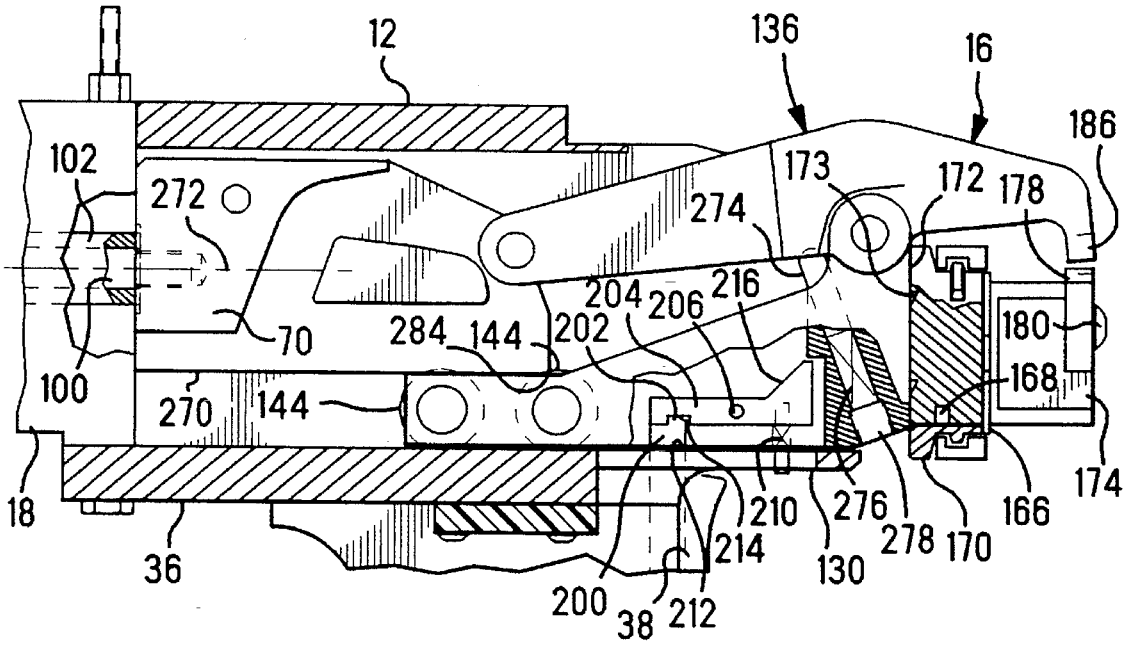
FIG. 10 is a cross-sectional view of a portion of the tool taken along the lines 10—10 in FIG. 2.
Figure 11:
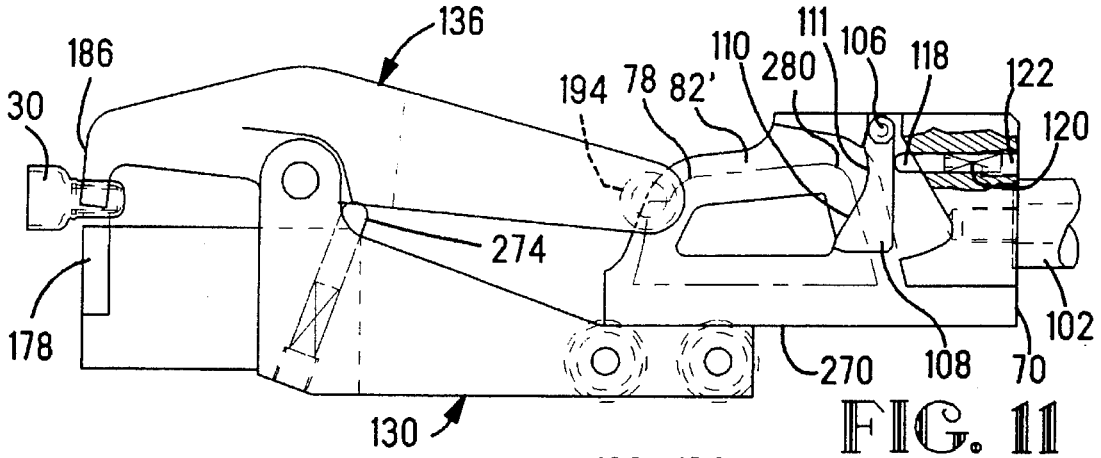
FIGS. 11 through 14 are schematic representations of a portion of the crimping mechanism showing the cam in various operating positions.
Figure 13:
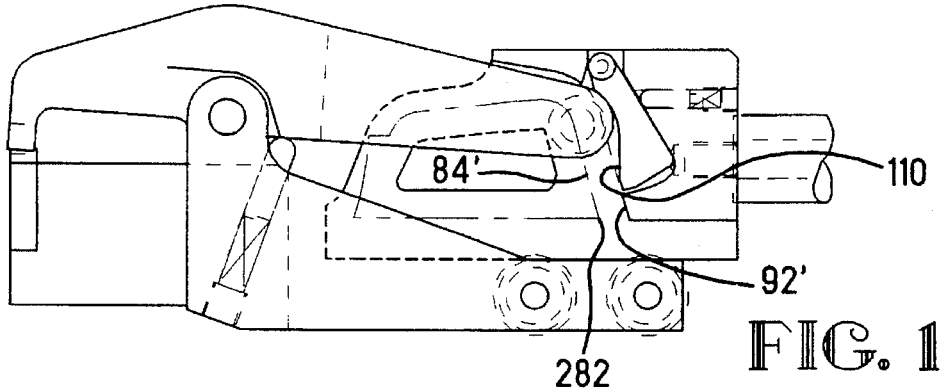

A steel cam 70 is central to the crimping mechanism 16 and is shown in FIGS. 4 through 7. The cam 70 includes a right side surface 72 and a left side surface 74 that are substantially flat and mutually parallel. A right cutout, or relief, is formed in the right side surface 72 to form a right cam track 76 and a similar cutout, or relief, is formed in the left side surface 74 to form a left cam track 78. Each cam track 76 and 78 completely surrounds a respective island having camming surfaces thereon. The left cam track includes an additional cutout 80 for receiving a pivotal gate, as will be described below, the right and left cam tracks are otherwise identical. The cam tracks 76 and 78 have a first portion 82, 82', a second portion 84, 84', and a third portion 86, 86', respectively. The first portions 82 and 82' include camming surfaces 88, 88', 90, and 90' for effecting the crimping operation, as will be explained below, and the second portions 84 and 84' include camming surfaces 92, 92', 94, and 94' for effecting opening of the crimping jaws after the crimping operation. Note that the surface 92' of the left cam track 78 is interrupted by the cutout 80. However, when the gate is in place within the cutout 80, a surface of the gate substantially bridges the interruption, as will be explained in more detail below. The cam 70 includes a threaded hole 98 for receiving a threaded end of a bolt 100 that extends through the piston rod 102 and attaches it tightly to the cam 70, as shown in FIG. 10. The cam 70 further includes a hole 104, as shown in FIG. 6, for receiving a pin 106 to pivotally attach a gate 108 to the cam within the cutout 80, as best seen in FIGS. 8 and 11. The gate 108 is arranged so that when it is pivoted fully within the cutout 80, as shown in FIG. 13, a surface 110 of the gate is substantially flush with the camming surface 92', however, the surface 110 is radiused somewhat at 111 for a purpose that will be explained. A hole 112 is formed into an end surface 114 of the cam and intersects the cutout 80, as best seen in FIGS. 6 and 7. The hole includes a threaded portion 116 at the end surface 114. As best seen in FIG. 11, a pin 118 having a rounded nose is a slip fit within the hole 112 and is backed up with a compression spring 120 which urges the pin toward the left so that the rounded nose engages and pushes against the side of the gate 108. This pivots the gate clockwise into the portion 84' of the track 78, as shown in FIG. 11. A set screw 122 is threaded into the end of the hole 112 to retain the spring and pin in place.

As shown in FIGS. 8 and 10, the crimping mechanism 16 includes a fixed member 130 having a pair of support arms 132 extending outwardly therefrom and a pair of attachment lugs 134 that extend upwardly therefrom. An indentor member 136 is pivotally attached to the fixed member 130 by means of a pin 138 that extends through holes 140 in the attachment lugs 134 and a hole 142 in the indentor member. A pair of rollers 144 are journaled for rotation between the two support arms by means of two pins 146 that extend through holes 148 that are formed through both support arms 132, the two support arms straddling the two rollers. Since the fixed member 130, the indentor 136, and the rollers 144 are load bearing components, they are made of steel. The crimping mechanism 16 is partially within a cavity 150 in the frame 12. Two holes 152 are formed completely through the frame and are sized to closely receive the pins 146 and another hole 154 is formed through the frame and is sized to closely receive the pin 138. When the crimping mechanism is in place within the cavity 150, the pin 138 extends completely through the assembly and is held in place by two retaining rings 156, E-rings in the present example, that fit into grooves in the ends of the pin. Each of the two pins 146 has a head 158 that is against the outer wall 160 of the frame 12 while the pins extend completely through the assembly and are held in place by means of two retaining rings 162 that fit into grooves in the pins. The fixed member 130 includes a cylindrically shaped feed drum support 164 for receiving the feed drum 24 and is sized so that the feed drum is free to rotate thereon. The internal bore of the feed drum includes a series of spaced detent grooves 166, shown in FIG. 8, which engage a ball detent 168 that is threaded into a hole in the feed drum support 164, as shown in FIG. 10. The grooves 166 are spaced to conform to the spacing of the terminals 30 on the tape 28 so that as the tape is advanced by the feed mechanism 22 the ball detent 168 will engage a groove 166 every time a terminal 30 is in crimping position. As described above, the tape guide 50 is arranged in guiding relationship around one half of the feed drum, as best seen in FIG. 3. The tape guide holds the tape 28 in engagement with the teeth 36 of the drum during operation of the tool 10. The tape guide 50 is attached to the side of the fixed member 130 by means of the two screws 54 which extend through the mounting flange 52 and into threaded holes in the fixed member. The feed drum 26 includes a flange 170 that is trapped between a face 172 of the fixed member 130 and the tape guide 50, thereby retaining the feed drum on the feed drum support 164. The surface of the flange 170 that opposes the face 172 includes a series of depressions 173, as best seen in FIG. 10, one depression for each detent groove 166. The depressions 173 are engaged by a feed dog to advance the tape 28, as will be explained in more detail below. A crimping die support 174 has an abutting shoulder 176 for receiving a crimping die 178. The crimping die is secured in place by means of a screw 180 which extends through a hole 182 in the die and into a threaded hole 184 in the die support 174, as shown in FIGS. 8 and 10. The indentor member 136 includes an indentor 186 at one end thereof that matingly engages the crimping die 178 for performing the crimping operation on the terminal 30. The other end includes two spaced apart arms 188 which straddle the cam 70. Each arm has a pin 190 pressed into a hole in the end thereof so that the two pins 190 are mutually opposing and extend into the space between the two arms. A pair of rollers 192 and 194 are journaled, one on each pin, so that the rollers are free to rotate. The two rollers 192 and 194 are cam followers in following engagement with the cam tracks 76 and 78, respectively, as will be explained in more detail below.

As set forth above, the trigger 38 controls the operation of the control valve 37 and, once actuated, must be latched in its actuated position until the operating cycle is complete, and then released to its initial position where it may be actuated again for the next cycle. The latch mechanism includes a latch member 200 that is secured to the trigger 38 and has a finger 202 that projects upwardly between the two support arms 132, as best seen in FIG. 10. A catch 204 is pivotally attached to the fixed member 130 by means of a pin 206 which extends through holes 208 in the arms 132. A compression spring 210 projects from a hole in the catch 204 and engages a surface 212 of the manifold 36 thereby urging the catch to pivot counterclockwise about the pin 206. The catch includes a notch 214 that latches onto the finger 202 to hold the trigger in its actuated position, as shown in FIG. 10. An inclined surface 216 is formed on the catch facing in the direction of the cam 70 for a purpose that will be explained.

Figure 9:
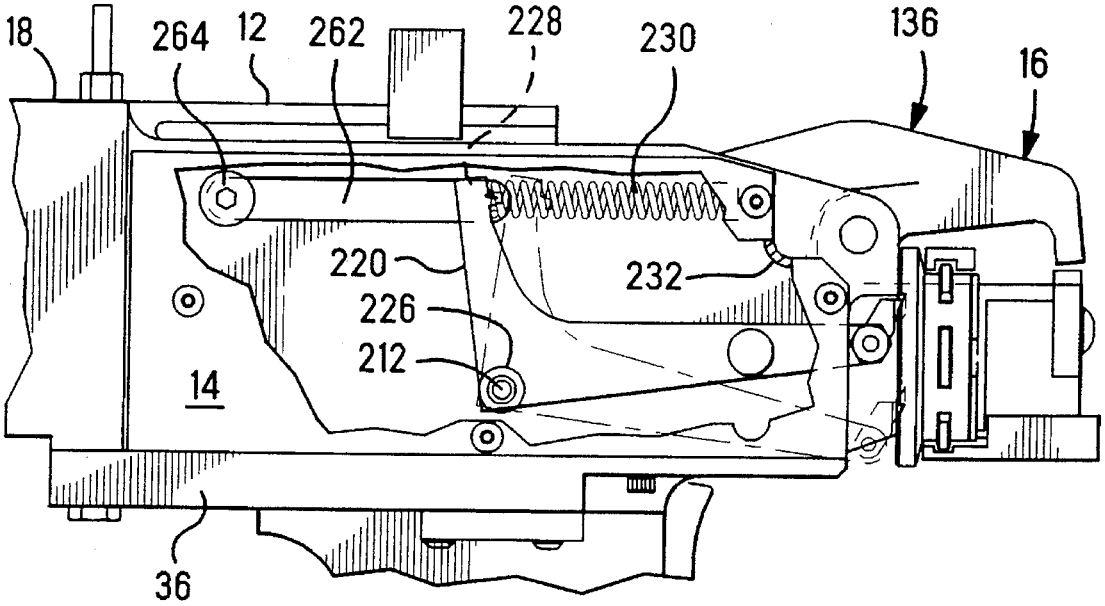
FIG. 9 is a partial side view of the tool showing a portion of the cover cut away.

The feed linkage that operates the feed mechanism 22, as best seen in FIGS. 8 and 9, includes an L-shaped feed arm 210 that is pivotally attached to the frame 12 by means of a pin 212 that is pressed into a hole 224 in a boss on the outer wall 160 of the frame. A bushing 226 is pressed into a hole in the feed arm 210 and is a slip fit with the pin 212. A short projection 228 is arranged on one end of the feed arm for retaining one end of a compression spring 230. The other end of the compression spring engages an inner wall 232 of the cover 14, as best seen in FIG. 9, thereby urging the feed arm 210 to pivot counterclockwise about the pin 212. A stud 234 has a threaded portion 236 that extends through a hole 238 in the other end of the feed arm and is secured thereto by a nut 240. A pin portion 238 extends outwardly from the stud for receiving a feed dog 244. The feed dog has a hole 246 that is a slip fit with the pin portion 242. The feed dog 244 is held on the pin portion by means of a retaining ring 248 which engages a groove in the end of the pin portion. The free end of the feed dog has a feed tooth 250 that is sized to engage an opening 32 in the tape 28. The feed dog is biased to pivot clockwise, as viewed in FIG. 9, about the pin portion 242 by means of a torsion spring 252 that is fixed to the stud 234. A cylindrically shaped handle 254 is attached to the feed arm 210 by means of a screw 256 that extends through a hole 258 in the arm and into a threaded hole in the handle. An elongated opening 260 is formed in the cover 14 in alignment with the handle 254 so that the handle can extend through the opening 260 and is accessible from outside the cover. The handle 254 is used to manually actuate the feed mechanism 22 by moving the handle downwardly and then releasing it so that it returns upwardly to its starting position under the urging of the spring 230. This is useful when loading a tape 28 into the feed mechanism 22. Another elongated opening 262 is formed in the outer wall 160 of the frame 12. A shoulder screw 264 is tightly threaded into a hole 266 in the side of the cam 70, as best seen in FIG. 8, and extends through the elongated opening 262 so that the head 268 of the screw is in a common plane with the feed arm 210. Therefore, when the cam is moved to the right by actuation of the cylinder 18, as viewed in FIG. 9, the head 268 will engage and pivot the feed arm 210 clockwise against the urging of the spring 230.

Figure 12:
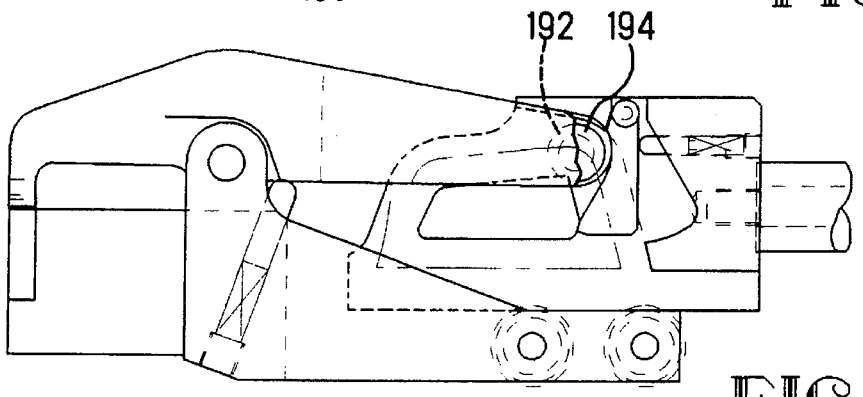
Figure 14:
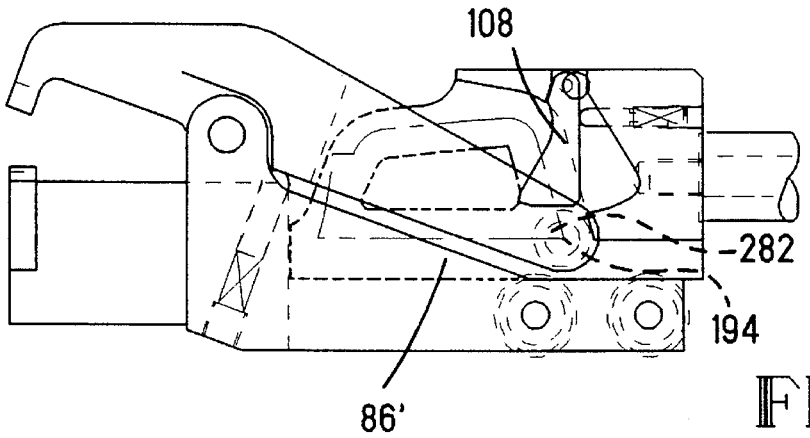

In operation, as shown in FIGS. 9 through 14, the cam 70 includes a bearing surface 270 that rides on the two rollers 144. The cylinder piston rod 102 is arranged to move the cam 70 along a longitudinal axis 272 that is substantially parallel to the bearing surface 270. Before actuation of the cylinder 18 the cam 70 is in its start position as shown in FIGS. 10 and 11. Additionally, the indentor member 136 is urged to pivot clockwise as viewed in FIG. 10, by a round nose pin 274 that is a slip fit within a hole formed in the fixed member 130. A compression spring 276, backed up by a set screw 278 that is threaded into the hole, urges the pin 274 into pushing engagement with the indentor member 136 so that the indentor 186 lightly engages the terminal 30, as shown in FIG. 11. As the trigger 38 is pulled it is latched in place by the catch 204, as described above, and the air cylinder pressurized so that the piston rod 102 begins to advance the cam 70 along the longitudinal axis 272 toward the left as viewed in FIG. 11. As motion continues, the followers 192 and 194 engage the camming surfaces 88 and 88' and ride up onto the camming surfaces 90 and 90', respectively. As the followers track along the first portions 82 and 82' of their respective tracks 176 and 178, they cam against the camming surfaces 90 and 90' and cause the indentor 186 to crimp the terminal 30 against the die 178. When the followers reach the end of their respective first portions 82 and 82', at an intersection 280 between the first and the second portions, they enter their respective second portions 84 and 84' of the tracks 76 and 78 as shown in FIG. 12. At this point the crimping die 178 and the indentor 186 are at their closest, which constitutes the shut height of the tool. It will be understood that every time the tool is cycled so that the followers track along the camming surfaces 90 and 90' and into the second portions of their respective cam tracks, the crimping die and the indentor will have the same shut height. As the piston rod continues to move the cam 70 toward the left, as viewed in FIG. 12, the follower 192 engages the camming surface 92 of the track 76 while the follower 194 engages the radiused surface 111 of the gate 108, thereby starting to pivot the gate counterclockwise into the cutout 80. The radiused surface 111 is shaped to cushion the movement of the gate somewhat so that it is not rapidly and violently thrown against the back wall of the cutout 80 as the follower first engages it. As the follower 192 engages the camming surface 92 of the track 76, both followers are forced downwardly until they reach an intersection 282 between the second and third portions, as shown in FIG. 14, and enter their respective third portions 86 and 86' of the tracks 76 and 78. Concurrently, the shoulder screw 264, which is carried by the cam 70, engages the feed arm 220 causing it to pivot clockwise against the urging of the spring 230, as viewed in FIG. 9, to the position shown in phantom lines, so that the feed dog 244 engages the next depression 173 in the feed drum 26. Additionally, concurrently with the last part of the piston rod stroke, a forward corner 284 of the cam 70, shown in FIG. 10, engages the inclined surface 216 of the catch 204 causing it to pivot clockwise, as viewed in FIG. 10, thereby releasing the latch member 200 so that the trigger 38 can return to its unactuated position. At this point the piston rod 102 is at the end of its stroke, the followers 192 and 194 are in the position shown in FIG. 14, and the gate 108 has pivoted clockwise, as viewed in FIG. 14, to its closed position blocking the second portion 84' of the cam track 78 so that the follower 94 is prevented from moving back into the second portion. The air cylinder 18 is then pressurized to return the piston rod to its original position thereby moving the cam 70 to the right, as viewed in FIG. 14. This causes the followers to follow along their respective third portions 86 and 86' of the cam tracks until they disengage all of the camming surfaces of the cam 70. The detent member 136 is then caused to pivot counterclockwise by the spring loaded pin 274 so that the followers move up to their start position shown in FIG. 11. During the return stroke of the cam 70, while the followers are trapped in the third portion 86 and 86' of the cam tracks, the shoulder screw 264 disengages the feed arm 220 allowing it to pivot counterclockwise, as viewed in FIG. 9, under the urging of the spring 230. As this occurs the feed dog 244 rotates the feed drum clockwise, as viewed in FIG. 3, one position so that the next terminal 30 is positioned between the indentor 186 and the crimping die 178, ready for the next crimping cycle, as shown in FIG. 11.

An important advantage of the present invention is that only the load bearing components are made of steel while the other components are made of aluminum or plastic resulting in a light weight tool that is well balanced and easy to handle. Another important advantage is that a single power stroke of the piston rod causes the indentor to first crimp the terminal and then to move away from the terminal so that it can immediately be removed from the tool. Concurrently with this power stroke the feed mechanism is actuated to store energy, in the spring 230, for operating the feed mechanism during the return stroke of the piston rod while the indentor is held away from the crimping die. A manual feed lever permits more control when loading a tape strip of terminals into the tool, and the trigger latch mechanism assures that the crimping mechanism, once actuated, completes its crimping cycle. This results in an effective and reliable tool that is relatively simple and inexpensive to manufacture.

We claim:

1. A powered hand tool for crimping a terminal onto an electrical conductor, said tool having a frame, a linear actuator having a piston rod arranged to move in a first direction and a second opposite direction along the longitudinal axis, a terminal crimping mechanism comprising:

(a) a fixed crimping jaw attached to said frame:

(b) a cam attached to and carried by said piston rod, said cam having a cam track including first, second, and third portions;

(c) an indent member pivotally attached to said frame and having a cam follower at one end thereof for following engagement with said cam track; and (d) a movable crimping jaw attached to another end of said indent member and arranged so that when said indent member is pivoted in one direction said movable crimping jaw matingly engages said fixed crimping jaw, wherein said cam track is arranged so that as said piston rod is moved in said first direction, said follower engages said cam and follows along said first portion of said cam track causing said indent member to pivot in said one direction thereby effecting the mating engagement of said movable and fixed jaws and then, while said piston rod continues to move in said first direction, said follower follows along said second portion of said cam track causing said indent member to pivot in an opposite direction thereby moving said jaws apart.

2. The tool according to claim 1 including a gate associated with said cam and arranged to direct said follower away from said first and second portions of said cam track so that upon movement of said piston rod in said second direction said follower follows along said third portion of said cam track until said follower disengages said cam.

3. The tool according to claim 2 wherein said gate is an elongated plate having one end pivotally attached to said cam for pivoting between an open position and a closed position, said gate including an abutting surface and another end opposite said one end, when said gate is in said closed position said abutting surface is disposed in a first intersection of said first and second portions of said cam track, and said another end is disposed in a second intersection of said second and third portions of said cam track so that as said follower moves along said first portion toward said second portion it engages said abutting surface and causes said gate to pivot away from said first and second intersections to an open position, and when said follower moves from said second portion into said third portion said gate is arranged to move to said closed position, thereby directing said follower away from said first and second portions of said cam track.

4. The tool according to claim 3 wherein said tool includes a resilient member coupled to said cam and arranged to urge said gate into said closed position so that when said follower passes from said second portion of said cam track into said third portion thereof, said gate moves toward said first and second intersections under said urging of said resilient member.

5. The tool according to claim 2 wherein said indent member includes a resilient member for biasing said indent member into a start position where said follower is in alignment with said first portion of said cam track so that upon said disengagement of said follower from said cam, said indent member moves to said start position.

6. A powered hand tool for crimping a terminal onto an electrical conductor, said tool having a frame, an actuator having a piston rod arranged to move in a first direction and a second opposite direction along a longitudinal axis, and a terminal crimping mechanism including a fixed crimping jaw attached to said frame; a cam attached to and carried by said piston rod, said cam having a cam track; an indent member pivotally attached to said frame having a cam follower at one end thereof for following engagement with said cam track; and a movable crimping jaw attached to another end of said indent member, a feed mechanism for feeding a strip of tape having terminals attached thereto so that each terminal in seriatim is positioned between said fixed and movable jaws comprising:

(a) a feed drum rotationally coupled to said frame adjacent said fixed jaw;

(b) a feed lever pivotally attached at one end to said frame and having a feed dog pivotally attached to another end thereof, said feed dog being biased into driving engagement with said feed drum when said feed lever is pivoted in one direction;

(c) a spring coupled to said feed lever and arranged to cause said feed lever to pivot in said one direction; and (d) an actuating projection extending from and carried by said cam and arranged so that when said piston rod moves said cam in said first direction, said actuating projection engages said feed lever and pivots it in a direction opposite said one direction thereby deflecting said spring and storing energy therein, and when said piston rod moves said cam in said second direction said actuating projection moves away from said engagement with said feed lever so that said stored energy in said spring will cause said feed lever to pivot in said one direction.

7. The tool according to claim 6 including a handle attached to said feed lever, said handle extending outwardly from said tool so that it can be manually manipulated to pivot said feed lever in said one direction and in said direction opposite said one direction.

8. The tool according to claim 7 wherein said feed drum includes at least one tooth arranged to drivingly engage an opening in said strip of tape for effecting said feeding thereof.

9. The tool according to claim 8 wherein said feed mechanism includes a detent for holding said feed drum in position while said feed lever is pivoted in said direction opposite said one direction.

10. A powered hand tool for crimping a terminal onto an electrical conductor, said tool having a frame, an actuator having a piston rod arranged to move in a first direction and a second opposite direction along its longitudinal axis, a terminal crimping mechanism including a fixed crimping jaw attached to said frame; a cam attached to and carried by said piston rod, said cam having a cam track including first and second portions; an indent member pivotally attached to said frame and having a cam follower at one end thereof for following engagement with said cam track; and a movable crimping jaw attached to another end of said indent member arranged so that when said indent member is pivoted in one direction said movable crimping jaw matingly engages said fixed crimping jaw, wherein said cam track is arranged so that as said piston rod is moved in said first direction, said follower engages said cam and follows along said first portion of said cam track causing said indent member to pivot in said one direction thereby effecting the mating engagement of said movable and fixed jaws, a manually operable trigger movable to a closed position for effecting operation of said actuator and to an open position discontinuing said operation, and a trigger latch mechanism for holding said trigger in said closed position until said followers traverse at least one of said first and second portions of said cam track.

11. The tool according to claim 10 wherein said trigger latching mechanism includes a latch member attached to said trigger and having a finger projecting therefrom, and a catch pivotally attached to said frame and having a shoulder attached thereto that is arranged to move into latching engagement with said finger when said catch is pivoted in one direction and to move out of latching engagement when said catch is pivoted in an opposite direction, including a spring arranged to bias said catch to pivot in said one direction, said catch including an inclined surface arranged so that said cam engages said inclined surface while said piston rod is moving in said first direction thereby pivoting said catch in said opposite direction against said bias of said spring.

12. A powered hand tool for crimping a terminal onto an electrical conductor, said tool having a frame, a linear actuator having a piston rod arranged to move in a first direction and a second opposite direction along the longitudinal axis, a terminal crimping mechanism comprising:

(a) a fixed crimping jaw attached to said frame:

(b) a cam attached to and carried by said piston rod, said cam having a first cam track on one side thereof including first, second, and third portions, and a second track on an opposite side thereof including first, second, and third portions;

(c) an indent member pivotally attached to said frame and having a first cam follower and a second cam follower at one end thereof for following engagement with said first and second cam tracks, respectively; and (d) a movable crimping jaw attached to another end of said indent member and arranged so that when said indent member is pivoted in one direction said movable crimping jaw matingly engages said fixed crimping jaw, wherein said first and second cam tracks are arranged so that as said piston rod is moved in said first direction, said first and second followers engage said cam and follow along said first portions of their respective said first and second cam tracks causing said indent member to pivot in said one direction thereby effecting the mating engagement of said movable and fixed jaws and then, while said piston rod continues to move in said first direction, said first and second followers follow along said second portions of their respective said first and second cam tracks causing said indent member to pivot in an opposite direction thereby moving said jaws apart.

13. The tool according to claim 12 including a gate associated with said cam and arranged to direct said first follower away from said first and second portions of said first cam track so that upon movement of said piston rod in said second direction said first follower follows along said third portion of said first cam track until said first follower disengages said cam.

* * * * *